US008714910B2

(12) United States Patent
Lenderink et al.

(10) Patent No.: US 8,714,910 B2
(45) Date of Patent: May 6, 2014

(54) COMPRESSOR UNIT AND ASSEMBLY METHOD

(75) Inventors: Gerrit Lenderink, Rietmolen (NL); Theo Nijhuis, Weerselo (NL)

(73) Assignee: Siemens Aktiengesellschaft, Munich (DE)

( * ) Notice: Subject to any disclaimer, the term of this patent is extended or adjusted under 35 U.S.C. 154(b) by 955 days.

(21) Appl. No.: 12/225,520

(22) PCT Filed: Mar. 22, 2007

(86) PCT No.: PCT/EP2007/052770

§ 371 (c)(1),
(2), (4) Date: Aug. 5, 2010

(87) PCT Pub. No.: WO2007/110378

PCT Pub. Date: Oct. 4, 2007

(65) Prior Publication Data

US 2010/0290896 A1 Nov. 18, 2010

(30) Foreign Application Priority Data

Mar. 24, 2006 (EP) ..... 06006065

(51) Int. Cl.
*F04D 29/58* (2006.01)

(52) U.S. Cl.
USPC ..... 415/116; 415/121.2; 415/176; 415/213.1

(58) Field of Classification Search
USPC ..... 415/169.1, 169.2, 116, 117, 175, 176, 415/121.2, 201; 417/423.8
See application file for complete search history.

(56) References Cited

U.S. PATENT DOCUMENTS

| | | | | |
|---|---|---|---|---|
| 2,435,470 | A * | 2/1948 | Samelson | 415/11 |
| 2,704,657 | A * | 3/1955 | Taylor | 165/96 |
| 3,104,964 | A | 9/1963 | Craft | |
| 5,044,440 | A * | 9/1991 | Stinessen et al. | 166/344 |
| 5,382,141 | A * | 1/1995 | Stinessen | 417/423.8 |
| 5,957,656 | A * | 9/1999 | De Long | 415/104 |
| 8,267,676 | B2 * | 9/2012 | Skofteland et al. | 417/423.3 |
| 2004/0170505 | A1 * | 9/2004 | Lenderink et al. | 417/244 |
| 2009/0035168 | A1 * | 2/2009 | Ginies et al. | 418/55.6 |

FOREIGN PATENT DOCUMENTS

| | | | |
|---|---|---|---|
| DE | 2223784 | B1 | 5/1973 |
| FR | 2349754 | A1 | 11/1977 |
| GB | 2017213 | A | 10/1979 |
| GB | 2 226 776 | A | 7/1990 |
| JP | 55007914 | A | 1/1980 |
| RU | 2159871 | C1 | 11/2000 |
| SU | 538155 | A1 | 12/1976 |

(Continued)

*Primary Examiner* — Ninh H Nguyen

(57) ABSTRACT

The invention relates to a compressor unit, in particular, for submarine application, comprising an electric motor. The transported medium for compression, in particular, natural gas for transport, not only frequently contains various aggressive chemical compounds but is also carrier of various condensates which hinder compression and in particular lead to increased wear of the compressor. On assembly aggressive sea water can also enter the compressor unit. The invention provides a solution to the above, wherein the rotation axis is arranged vertically during operation and the housing comprises a drain at the lower axial end. The invention further relates to an assembly method for a compressor unit, in which the compressor unit is filed above water with an incompressible fluid, transported to a submarine operating position, connectors are connected to the inlet and the outlet and the fluid removed from the compressor unit through the drain.

14 Claims, 3 Drawing Sheets

(56) References Cited

FOREIGN PATENT DOCUMENTS

| | | | |
|---|---|---|---|
| SU | 578492 | A1 | 10/1977 |
| SU | 1664119 | A3 | 7/1991 |
| WO | WO 92/14062 | A1 | 8/1992 |
| WO | WO 95/15428 | A1 | 6/1995 |

* cited by examiner

COMPRESSOR UNIT AND ASSEMBLY METHOD

CROSS REFERENCE TO RELATED APPLICATIONS

This application is the US National Stage of International Application No. PCT/EP2007/052770, filed Mar. 22, 2007 and claims the benefit thereof. The International Application claims the benefits of European application No. 06006065.4 filed Mar. 24, 2006, both of the applications are incorporated by reference herein in their entirety.

FIELD OF INVENTION

The invention relates to a compressor unit, in particular for underwater operation, comprising a compressor and an electric motor, which compressor unit has a housing with an inlet and an outlet for a pumping medium, having a rotation axis around which a rotor of the compressor unit can rotate, wherein electromagnetic bearings (21, 22, 25) are provided which are cooled to the operating temperature by means of a cooling system, wherein the cooling system provides a tap in an overflow of the compressor and a portion of the pumping medium is conveyed from the tap 32 by means of pipelines through a filter 35, and then passed through two separate pipelines to the bearings.

BACKGROUND OF THE INVENTION

Recent developments in the field of compressor design have also been concentrated on undersea arrangements of large compressors which are intended to be used for the pumping of natural gases. Because of the particular operating conditions, in particular because of the greatly restricted accessibility both for maintenance purposes and by means of supply lines, the specialists are confronted with major requirements. The relevant environmental regulations forbid any exchange of substances between the equipment to be installed and the surrounding sea water. Furthermore, sea water is an aggressive medium and extreme pressure and temperature conditions can be found at the various depths in the sea. A further requirement is that the equipment should on the one hand have an extremely long life and on the other hand must be designed to be virtually free of maintenance. An additional exacerbating factor is not-inconsiderable contamination of the medium to be pumped which in some cases is chemically aggressive.

The pumping medium to be compressed, in particular natural gas to be pumped, not only has a frequently varying aggressive chemical composition but is also a carrier of various types of condensation which make compression more difficult, and in particular lead to increased wear of the compressor. For this reason, condensation is separated before the compression process. Even when using very complex separation technology, it is not possible to prevent subsequent deposition of condensation in the compressor unit as well, and this can at least adversely affect the life of a compressor unit. In the case of a compressor unit which is operated under water, there is a further problem in that the lines which supply the pumping medium and carry it away are normally connected only at the operating location and the surrounding medium, for example aggressive seawater, can enter the compressor unit even while it is being transported there, and can lead to damage in the compressor unit.

International patent application WO 92/14062 has already disclosed a pumping station for underwater operation, which also has a compressor which pumps gaseous components from a source of a raw fossil substance from the seabed to land. This document proposes that the rotors of the pumping machines be mounted by means of oil journal bearings, which are lubricated by means of an oil film. The housings of the turbomachines are positioned vertically and, at the lowest point, have a permanently open oil outlet through which other gases and condensation are also dissipated out of the housing. The liquid components from what emerges are pumped to the land, where they are separated. Separate pipelines and a complex processing installation must accordingly be provided. GB 2 226 776 A and WO 95/15428 also disclose an installation such as that in WO 92/14062.

SUMMARY OF INVENTION

Against the background of the problems of the prior art, the object of the invention is to avoid potential damage caused by condensation and other liquids in a compressor unit which is intended in particular for underwater operation without increasing the amount of effort for erection and installation.

A compressor unit and a method for assembly of a compressor unit are proposed in order to achieve the object according to the invention.

One major advantage of the combination of vertical installation with a drain at the lower axial end of the housing is that, on the one hand, the elongated extent along the rotation axis results in particularly favorable conditions for draining, because the higher water pressure head results in higher hydrostatic pressures which ensure that the condensation flows away out of the housing better. In consequence, condensation also flows away through the drain, which is located at the lower axial end of the housing, driven by the higher hydrostatic pressure resulting from the vertical alignment.

In order to ensure that liquids flow away without any residue, it is expedient for the surfaces in the interior of the compressor unit to be designed such that, when aligned vertically for operation, liquids which are located in the interior of the housing reach the drain just by flowing as a result of the force of gravity. For this purpose, the surfaces which face away from the drain have an inclination which results in a flow to the drain. According to the invention, no undercuts which are suitable for collection of liquid are provided with respect to the drain in the housing interior.

In order to carry condensation away without any residue and in order to overcome any pressure differences, it is expedient for a pump which carries the condensation away to be connected to the drain, which is in the form of an opening.

For assembly processes, it is furthermore expedient for the housing of the compressor unit to be mounted in a frame by means of supporting elements which are provided on the housing, with this mounting being configured such that the housing can rotate about a horizontal axis in the area of the rotor's center of gravity and the drain thus changes from a low point to a high point during the course of rotation.

This development of the invention is particularly expedient when an assembly method for a compressor unit to be operated under water provides that the compressor unit is filled under water with an incompressible fluid before being lowered to the operating location, is then transported to the operating location under water, the connections are connected to the inlet and to the outlet and finally the fluid is emptied out of the compressor unit through the drain. In order to prevent any exchange with the surrounding medium under water, it is worthwhile for the inlet and the outlet to be closed above water, before the incompressible fluid is introduced, and for these closures to be removed again before the connections are connected to the inlet and the outlet. In order to fill the housing of the compressor unit, it is worthwhile for it to be rotated around a horizontal axis as described above, such that the drain is located at the upper axial end. The housing can be completely filled with the incompressible fluid through the drain, particularly if the interior of the housing is designed such that, during operation, liquids can flow completely to the drain because of the force of gravity and the compressor unit is located with the lower axial end at the top for filling. The corresponding inclination of the surfaces ensures that no compressible gas bubbles can remain in the housing while it is being filled with the incompressible fluid. By way of example, distilled water or demineralized water may be used as the incompressible fluid, as a result of which the interior of the compressor unit is not subjected to the damaging influence of the surrounding medium, for example the seawater, and, at the same time, the closures of the inlet and outlet need not withstand any particular pressure load under water in the course of transportation of the compressor unit to the operating location.

BRIEF DESCRIPTION OF THE DRAWINGS

It is also expedient to close the inlet and the outlet of the filled housing, so that no fish swim into the compressor unit and no prawns creep into it.

The invention will be described in more detail in the following text using one specific exemplary embodiment and with reference to the drawings. The illustrated embodiment should be regarded as only as being illustrative as an example of the invention.

In the figures:

FIG. 1 shows a schematic illustration of a longitudinal section through a compressor unit, FIGS. 2, 3 each show a schematic illustration of method steps of the assembly method according to the invention.

DETAILED DESCRIPTION OF INVENTION

Figure 1:
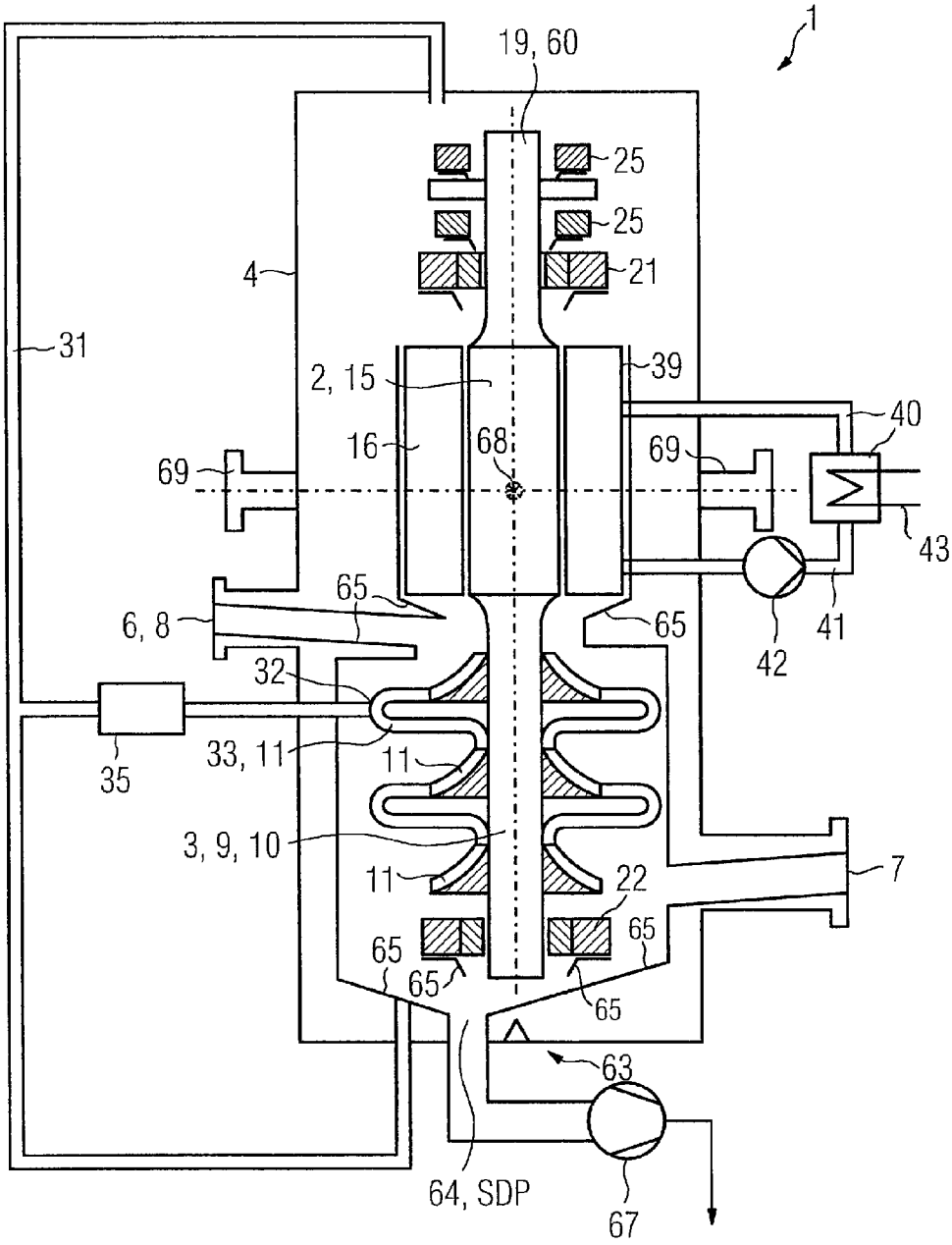

FIG. 1 shows a section along a compressor unit 1 according to the invention which has, as major components, a motor 2 and a compressor 3 in a gas-tight housing 4. The housing 4 accommodates the motor 2 and the compressor 3. The housing 4 is provided with an inlet 6 and an outlet 7 in the area of the junction between the motor 2 and the compressor 3, with the fluid to be compressed being sucked in through the inlet 6 by means of a suction connecting stub 8, and with the compressed fluid flowing out through the outlet 7.

The compressor unit 1 is arranged vertically during operation, with a motor rotor 15 of the motor 2 above a compressor rotor 9 of the compressor 3 being combined to form a common shaft 19 which rotates about a common vertical rotation axis 60.

The motor rotor 15 is borne in a first radial bearing 21 at the upper end of the motor rotor 15.

The compressor rotor 9 is mounted in a second radial bearing 22 in a lower position.

An axial bearing 25 is provided at the upper end of the common shaft 19, that is to say at the upper end of the motor rotor 15. The radial bearings 21, 22 and the axial bearing 25 operate electromagnetically and are each encapsulated. In this case, the radial bearings 21, 22 extend around the respective bearing point of the shaft 19 in the circumferential direction and in this case are circumferential through 360° and are undivided.

The compressor 3 is in the form of a centrifugal compressor and has three compressor stages 11 which are each connected by means of an overflow 33. The pressure differences which result across the compressor stages 11 ensure that there is a thrust on the compressor rotor 9 which is transmitted via the coupling 18 on the motor rotor 15 and is directed against the force of gravity from the entire resultant rotor comprising the compressor rotor 9 and the motor rotor 15, thus resulting in a very high degree of thrust matching during rated operation. This allows the axial bearing 25 to be designed to be comparatively smaller than in a horizontal arrangement.

The electromagnetic bearings 21, 22, 25 are cooled to the operating temperature by means of a cooling system 31, with the cooling system 31 providing a tap 32 in an overflow of the compressor 3. A portion of the pumping medium, which is preferably natural gas, is passed from the tap 32 by means of pipelines through a filter 35, and is then passed through two separate pipelines to the respective outer bearing points (first radial bearing 21 and second radial bearing 22 as well as the axial bearing 25). This cooling by means of the cold pumping medium saves additional supply lines.

The motor rotor 15 is surrounded by a stator 16 which has encapsulation 39 such that the aggressive pumping medium does not damage the windings of the stator 16. The encapsulation 39 is in this case preferably designed such that it can contribute to the full operating pressure. This is also because a separate stator cooling arrangement 40 is provided and pumps a dedicated cooling medium 41 via a heat exchanger 43 by means of a pump 42. At the least the encapsulation 39 is designed such that the section which extends between the stator 16 and the motor rotor 15, while having a thin wall thickness, is nevertheless able to withstand the design pressure when the stator cooling arrangement 40 is completely filled by means of the cooling medium 41. This makes it possible to avoid relatively high eddy current losses in this area, thus improving the efficiency of the overall arrangement.

The compressor rotor 9 expediently has a compressor shaft 10 on which the individual compressor stages 11 are mounted. This can preferably be achieved by means of a thermal shrink fit. An interlock is likewise possible, for example by means of polygons. Another embodiment provides for different compressor stages 11 to be welded to one another, thus resulting in an integral compressor rotor 9.

A drain point SDP, at which a drain 64 in the form of an opening in the housing 4 is located, is located at the lower axial end 63 of the housing 4 in the vertical operating position. All the liquid which is located in the interior of the housing 4 is collected at the drain point SDP, flowing away just as a result of the force of gravity. For this purpose, all of the surfaces in the interior of the compressor unit are designed such that, when aligned vertically during operation, the inclination 65 of the surfaces reliably prevents liquid from accumulating accept at the drain point. A condensation pump 67 is connected to the drain 64 and carries away the liquid that collects there. Supporting elements 69 are provided on the housing in the axial area of the rotor's center of gravity 68, and offer the capabilities to fit stop means at stop points.

Figure 2:
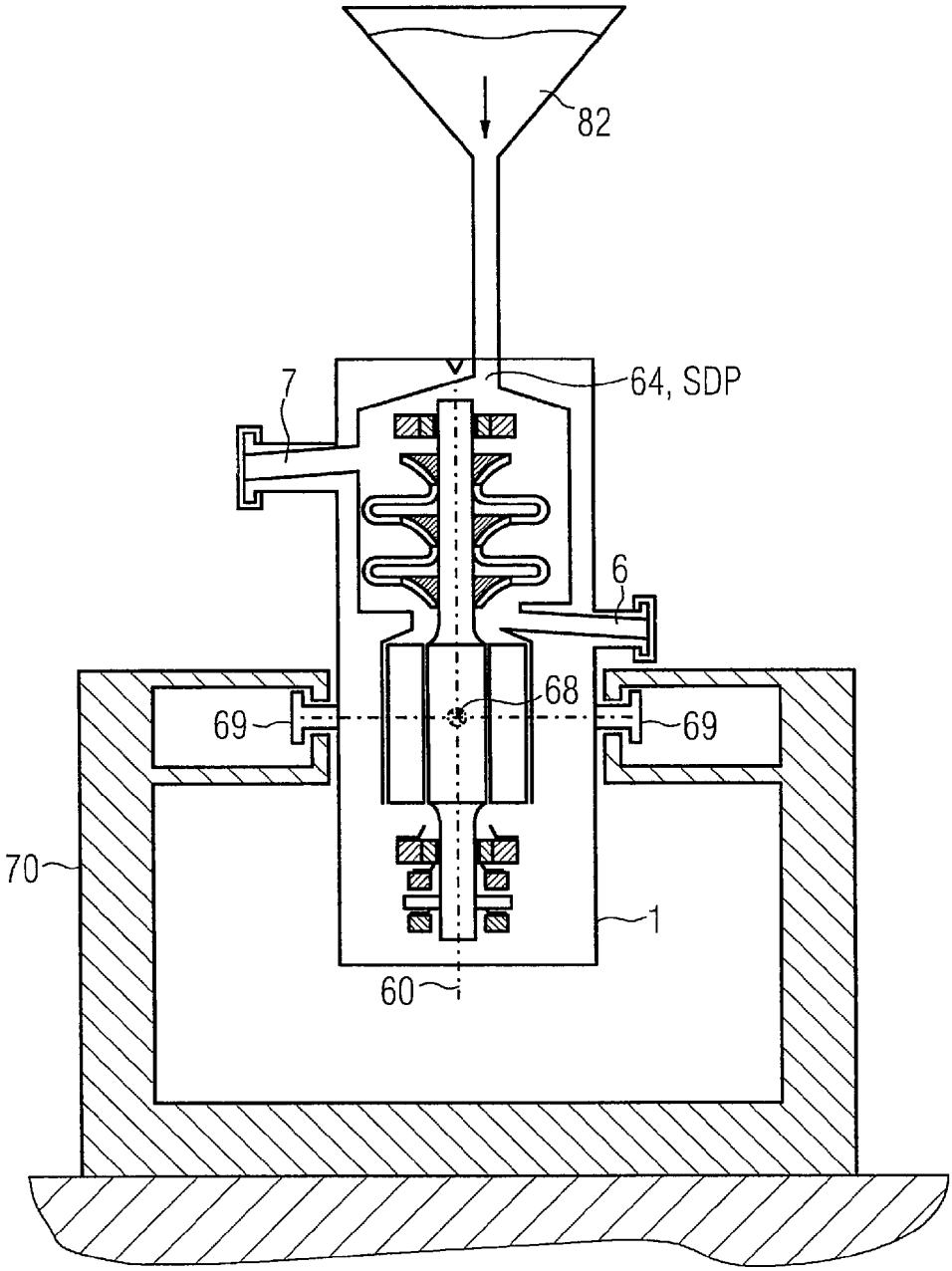
Figure 3:
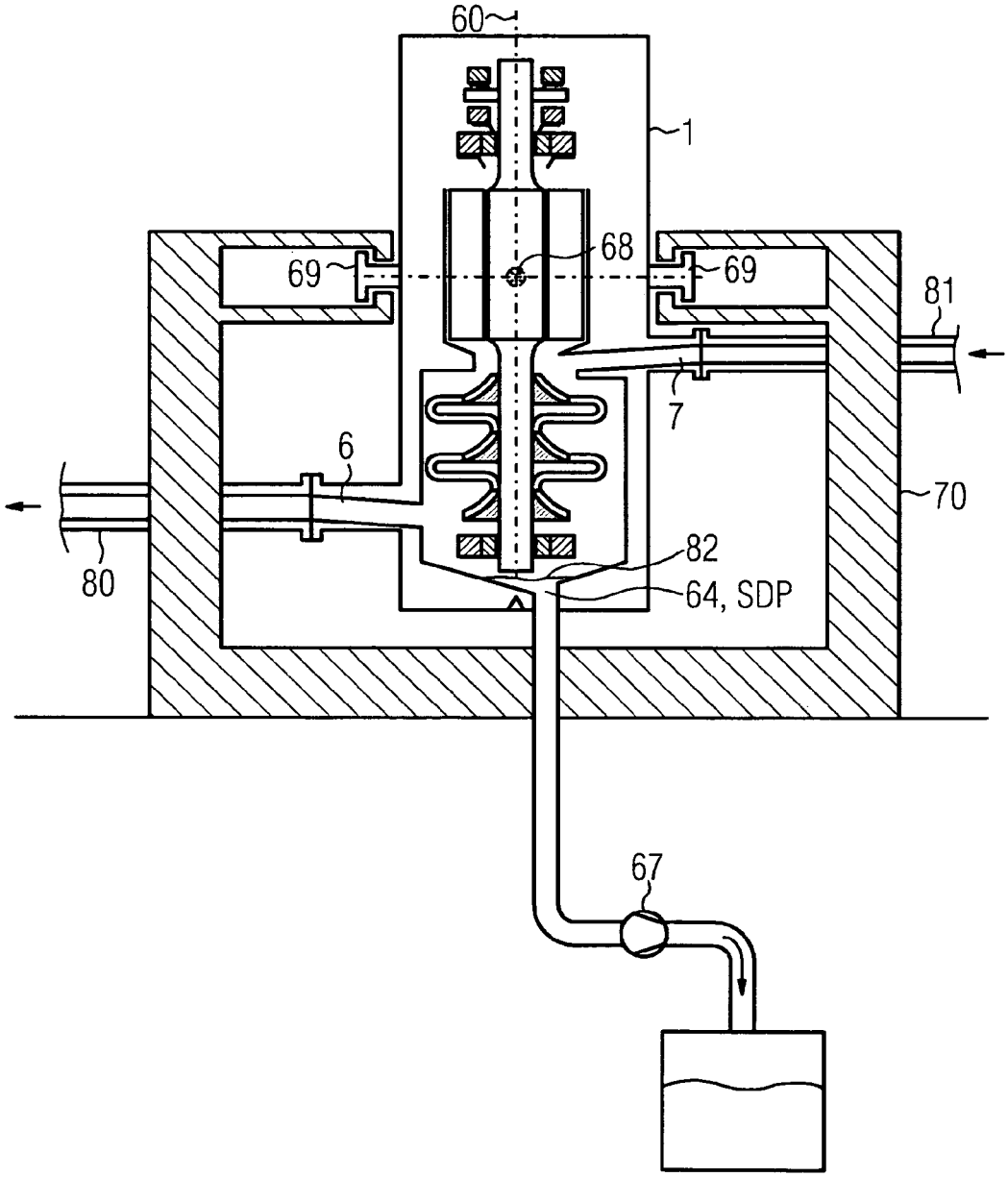

The supporting elements 69 allow accommodation in a frame 70, as is illustrated in FIGS. 2 and 3. The accommodation in the frame 70 is designed so as to allow the compressor unit 1 to rotate around a horizontal axis. This allows the drain 64 to be rotated from the lowest point, based on the vertical operating alignment, to the highest point.

The assembly method according to the invention provides that, in a first step, the compressor unit 1 is oriented in the frame 70 in a mirror-image form with respect to the operating position, with the drain 64 at the top, and the rotation axis 60 aligned vertically. In this position, the compressor unit 1 is filled, with the inlet 6 and the outlet 7 closed, by means of an incompressible fluid 82, specifically by means of distilled or demineralized water. The compressor unit 1 is then rotated back to the operating position, and is transported to the operating location under water. Finally, with the closures on the inlet 6 and on the outlet 7 being removed, a respective line 80, 81 for a pumping medium is connected, and the condensation pump 67, with the adjacent condensation collection container 80, is connected to the drain 64. Before starting up the compressor unit 1, the fluid filling in the condensation pump 67 is pumped out of the interior of the compressor unit 1.

The invention claimed is:

1. A compressor unit for underwater operation, comprising:

a compressor and an electric motor, having a housing with an inlet and an outlet for a pumping medium, and a rotation axis around which a rotor rotates;

a cooling system that cools electromagnetic bearings of the compressor unit to an operating temperature, wherein the cooling system provides a tap in an overflow of the compressor and a portion of the pumping medium is conveyed from the tap via pipelines through a filter, and then passed through two separate pipelines to the bearings, wherein the rotation axis is aligned vertically during operation and the housing has a drain at an axial end located at the bottom, wherein the housing is mounted in a frame via supporting elements provided on the housing such that the housing is rotatable about a horizontal axis such that the drain changes from a low point to a high point.

2. The compressor unit as claimed in claim 1, wherein only interior surfaces of the compressor unit are constructed and arranged such that, when aligned vertically for operation, liquids located in the interior of the housing flow away due to the force of gravity and reach the drain.

3. The compressor unit as claimed in claim 2, wherein surfaces which continue from the drain are inclined in the interior of the compressor unit such that these wetting liquids flow away from the surfaces in the direction of the drain, when aligned vertically for operation.

4. The compressor unit as claimed in claim 1, wherein a condensation pump is connected to the drain and carries liquid away.

5. The compressor unit as claimed in claim 1, wherein the horizontal axis around which the housing rotates runs in the area of the rotor center of gravity.

6. A compressor unit for underwater operation, comprising:

a compressor and an electric motor, having a housing with an inlet and an outlet for a pumping medium, and a rotation axis around which a rotor rotates;

a cooling system that cools electromagnetic bearings of the compressor unit to an operating temperature, wherein the cooling system provides a tap in an overflow of the compressor and a portion of the pumping medium is conveyed from the tap via pipelines through a filter, and then passed through two separate pipelines to the bearings, wherein the rotation axis is aligned vertically during operation and the housing has a drain at an axial end located at the bottom, wherein only interior surfaces of the compressor unit are constructed and arranged such that, when aligned vertically for operation, liquids located in the interior of the housing flow away due to the force of gravity and reach the drain, wherein surfaces which continue from the drain are inclined in the interior of the compressor unit such that these wetting liquids flow away from the surfaces in the direction of the drain, when aligned vertically for operation, wherein a condensation pump is connected to the drain and carries liquid away, and wherein the housing is mounted in a frame via supporting elements provided on the housing such that the housing is rotatable about a horizontal axis such that the drain changes from a low point to a high point.

7. The compressor unit as claimed in claim 6, wherein the horizontal axis around which the housing rotates runs in the area of the rotor center of gravity.

8. A method of assembly for an underwater compressor unit, having a compressor and an electric motor, the compressor unit having a housing with an inlet and an outlet for a pumping medium, and a rotation axis around which a rotor rotates, a cooling system that cools electromagnetic bearings of the compressor unit to an operating temperature, comprising:

filling the compressor unit with an incompressible fluid while the unit is above water;

transported the unit to an operating location under water;

connecting connections to the inlet and to the outlet of the unit; and pumping the fluid out of the compressor unit through the drain, wherein the cooling system provides a tap in an overflow of the compressor and a portion of the pumping medium is conveyed from the tap via pipelines through a filter, and then passed through two separate pipelines to the bearings, wherein the rotation axis is aligned vertically during operation and the housing has a drain at an axial end located at the bottom.

9. The method as claimed in claim 8, wherein the fluid is distilled or demineralized water.

10. The method as claimed in claim 8, wherein only interior surfaces of the compressor unit are constructed and arranged such that, when aligned vertically for operation, liquids located in the interior of the housing flow away due to the force of gravity and reach the drain.

11. The method as claimed in claim 10, wherein surfaces which continue from the drain are inclined in the interior of the compressor unit such that these wetting liquids flow away from the surfaces in the direction of the drain, when aligned vertically for operation.

12. The method as claimed in claim 11, wherein a condensation pump is connected to the drain and carries liquid away.

13. The method as claimed in claim 12, wherein the housing is mounted in a frame via supporting elements provided on the housing such that the housing is rotatable about a horizontal axis and such that the drain changes from a low point to a high point.

14. The method as claimed in claim 13, wherein the horizontal axis around which the housing rotates is arranged in an area of the rotor center of gravity.

* * * * *